US009481436B2

(12) United States Patent
Shomura et al.

(10) Patent No.: US 9,481,436 B2
(45) Date of Patent: Nov. 1, 2016

(54) SHIFT CONTROL DEVICE OF OUTBOARD MOTOR, SHIFT CONTROL METHOD OF OUTBOARD MOTOR AND PROGRAM

(71) Applicant: SUZUKI MOTOR CORPORATION, Hamamatsu-shi, Shizuoka (JP)

(72) Inventors: Nobuyuki Shomura, Hamamatsu (JP); Hitoshi Matsumura, Hamamatsu (JP); Masahiro Nanba, Hamamatsu (JP)

(73) Assignee: SUZUKI MOTOR CORPORATION, Hamamatsu-Shi, Shizuoka (JP)

( * ) Notice: Subject to any disclaimer, the term of this patent is extended or adjusted under 35 U.S.C. 154(b) by 24 days.

(21) Appl. No.: 14/409,056

(22) PCT Filed: Jun. 12, 2013

(86) PCT No.: PCT/JP2013/066151

§ 371 (c)(1),
(2) Date: Dec. 18, 2014

(87) PCT Pub. No.: WO2014/002760

PCT Pub. Date: Jan. 3, 2014

(65) Prior Publication Data

US 2015/0360762 A1 Dec. 17, 2015

(30) Foreign Application Priority Data

Jun. 25, 2012 (JP) ..... 2012-142346

(51) Int. Cl.

| | |
|---|---|
| ***B63H 20/14*** | (2006.01) |
| ***B63H 21/21*** | (2006.01) |
| ***B63J 99/00*** | (2009.01) |

(52) U.S. Cl.

CPC ..... *B63H 20/14* (2013.01); *B63H 21/21* (2013.01); *B63H 21/213* (2013.01); *B63J 99/00* (2013.01); *B63J 2099/006* (2013.01)

(58) Field of Classification Search

CPC .... B63H 20/14; B63H 21/213; B63H 21/21; B63J 99/00; B63J 2099/006

USPC ..... 701/21

See application file for complete search history.

(56) References Cited

U.S. PATENT DOCUMENTS 5,151,059 A 9/1992 Higby
8,700,238 B2 * 4/2014 Hiramatsu ..... B63H 21/213 114/144 R (Continued)

FOREIGN PATENT DOCUMENTS

EP 1 857 357 A2 11/2007
EP 1 958 869 A1 8/2008

(Continued)

OTHER PUBLICATIONS

International Search Report dated Sep. 17, 2013, which issued during prosecution of International Application No. PCT/JP2013/066151, which corresponds to the present application.

(Continued)

*Primary Examiner* — Richard Camby
(74) *Attorney, Agent, or Firm* — Troutman Sanders LLP

(57) ABSTRACT

A shift control device of an outboard motor having an electrical shift device for switching a propulsion direction has a rotation switching unit electrically switching whether to drive the outboard motor for regular rotation or for counter rotation, and a rotation determination unit determining whether the outboard motor drives for regular rotation or for counter rotation. Desired performances can be obtained by the outboard motor for regular rotation and the outboard motor for counter rotation without complicating the operation even when the propulsion unit for regular rotation and the propulsion unit for counter rotation are made as a common unit.

9 Claims, 10 Drawing Sheets

(56) References Cited

U.S. PATENT DOCUMENTS

| | | | | |
|---|---|---|---|---|
| 2004/0198109 | A1 | 10/2004 | Ochiai | |
| 2006/0009096 | A1 | 1/2006 | Takada et al. | |
| 2008/0014806 | A1 | 1/2008 | Ide et al. | |
| 2008/0113569 | A1 | 5/2008 | Kaji | |
| 2008/0182464 | A1 | 7/2008 | Kado et al. | |
| 2010/0099310 | A1 | 4/2010 | Kuriyagawa et al. | |
| 2010/0191396 | A1* | 7/2010 | Nose et al. ..... | B63H 25/42 701/21 |

FOREIGN PATENT DOCUMENTS

| | | |
|---|---|---|
| GB | 2 152 164 | 7/1985 |
| JP | S60-241552 | 11/1985 |
| JP | H05-170182 | 7/1993 |
| JP | 2002-308185 | 10/2001 |
| JP | 2008-007070 | 1/2008 |

OTHER PUBLICATIONS

International Preliminary Report on Patentability and Written Opinion of the International Searching Authority dated Dec. 31, 2014, which issued during prosecution of International Application No. PCT/JP2013/066151, which corresponds to the present application. Extended European Search Report dated Jul. 26, 2016 of the corresponding EPC patent application No. 13810221.5.

* cited by examiner

FIG.7

| ROTATION INFORMATION | SHIFT POSITION | ROTATION DIRECTION OF SHIFT ROD BY ELECTRICAL SHIFT DEVICE |
|---|---|---|
| REGULAR ROTATION | FORWARD DIRECTION | LEFTWARD ROTATION |
| REGULAR ROTATION | BACKWARD DIRECTION | RIGHTWARD ROTATION |
| COUNTER ROTATION | FORWARD DIRECTION | RIGHTWARD ROTATION |
| COUNTER ROTATION | BACKWARD DIRECTION | LEFTWARD ROTATION |

SHIFT CONTROL DEVICE OF OUTBOARD MOTOR, SHIFT CONTROL METHOD OF OUTBOARD MOTOR AND PROGRAM

CROSS REFERENCE TO RELATED APPLICATIONS

This application is a U.S. National Phase Application under 35 U.S.C. §371 of International Patent Application PCT/JP2013/066151 filed Jun. 12, 2013 which claims priority to Japanese Patent Application No. 2012-142346 filed Jun. 25, 2012. The International Application was published on Jan. 3, 2014, as International Publication No. WO 2014/002760 under PCT Article 21(2). The entire contents of these applications are hereby incorporated by reference.

TECHNICAL FIELD

The present invention relates to a shift control device of an outboard motor, a shift control method of an outboard motor and a program. In particular, the present invention is preferred for use in the case where a propulsion unit for regular rotation and a propulsion unit for counter rotation are made as a common unit.

BACKGROUND ART

In a large hull or the like, there may be cases where plural outboard motors are mounted for obtaining larger propulsive force. The outboard motors obtain propulsive force by rotating a propeller, and thus rotation reaction force of the propeller may operate to the hull mounting the outboard motors to cause a side slide. Therefore, when plural outboard motors are mounted in the hull, to suppress the side slide, generally rotation directions of the propellers of respective outboard motors are set in opposite directions, making them for regular rotation and for counter rotation.

In the outboard motor for regular rotation, the propeller rotates rightward when seen in a traveling direction while moving forward, and in the outboard motor for counter rotation, the propeller rotates leftward when seen in the traveling direction while moving forward.

In general, the outboard motor for regular rotation and the outboard motor for counter rotation have different gears for switching the rotation direction of the propeller. This is because required performances are different in terms of use time (durability) and transfer torque (strength) between a gear for moving forward and a gear for moving backward, and is for using gears corresponding to the required performances for the gear for moving forward and the gear for moving backward to thereby reduce production costs. In such a structure, it is necessary to prepare a dedicated propulsion unit (gear case) for each of the outboard motor for regular rotation and the outboard motor for counter rotation. Thus, management of parts is complicated and retail stores always have to stock two types of propulsion units, and this increases management costs and has been a main cause for rise of sales costs.

Regarding such a program, Patent Literature 1 discloses a technology of making the gear case for regular rotation and the gear case for counter rotation as a common unit by similarly structuring a gear for moving forward and a gear for moving backward and also a bearing of the gear for moving forward and a bearing of the gear for moving backward.

CITATION LIST

Patent Literature

Patent Literature 1: Japanese Laid-open Patent Publication No. 60-241552

SUMMARY OF INVENTION

Technical Problem

When the outboard motor for regular rotation and the outboard motor for counter rotation are operated, in general, independent remote control levers mechanically coupled to the respective outboard motors are provided. However, when the outboard motor for regular rotation and the outboard motor for counter rotation which use the gear case of Patent Literature 1 are operated, operating directions of the remote control levers become completely reverse, which can make the operation complicated.

Further, it is necessary to attach a dedicated propeller in each of the outboard motor for regular rotation and the outboard motor for counter rotation, by which desired performances cannot be obtained unless specifications of the remote control levers, the outboard motors and the propellers match.

The present invention is made in view of the above-described problem, and it is an object thereof to allow obtaining desired performances by the outboard motor for regular rotation and the outboard motor for counter rotation without complicating the operation even when the propulsion unit for regular rotation and the propulsion unit for counter rotation are made as a common unit.

Solution to Problem

A shift control device according to the present invention is a shift control device of an outboard motor having an electrical shift device for switching a propulsion direction, the shift control device including a rotation switching unit electrically switching whether to drive the outboard motor for regular rotation or for counter rotation, and a rotation determination unit determining whether the outboard motor drives for regular rotation or for counter rotation.

A shift control method according to an outboard motor according to the present invention is a shift control method of an outboard motor having an electrical shift device for switching a propulsion direction, the shift control method including a rotation switching step of electrically switching whether to drive the outboard motor for regular rotation or for counter rotation, and a rotation determination step of determining whether the outboard motor drives for regular rotation or for counter rotation.

A program according to the present invention is a program for controlling an outboard motor having an electrical shift device for switching a propulsion direction, the program causing a computer to execute a rotation switching step of electrically switching whether to drive the outboard motor for regular rotation or for counter rotation, and a rotation determination step of determining whether the outboard motor drives for regular rotation or for counter rotation.

Advantageous Effects of Invention

According to the present invention, desired performances can be obtained by the outboard motor for regular rotation and the outboard motor for counter rotation without complicating the operation even when the propulsion unit for regular rotation and the propulsion unit for counter rotation are made as a common unit.

BRIEF DESCRIPTION OF DRAWINGS

FIG. 7 is a diagram illustrating a table in which rotation information, signals of shift position and rotation directions of shift rod by an electrical shift device are associated.

DESCRIPTION OF EMBODIMENTS

Hereinafter, preferred embodiments of the present invention will be described with reference to the attached drawings.

Figure 1:
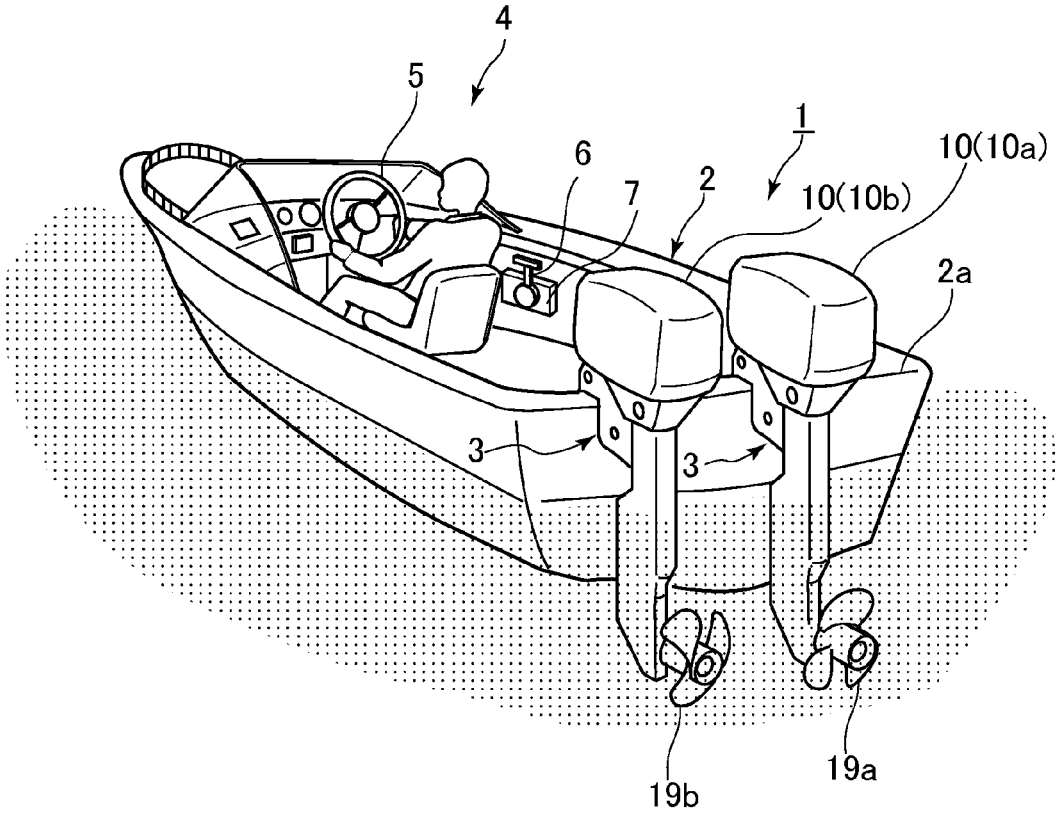
FIG. 1 is a perspective view seeing a boat from an obliquely rear direction.

FIG. 1 is a perspective view seeing a boat from an obliquely rear direction. As illustrated in FIG. 1, to a transom 2*a* located on a rear part of a hull 2 of a boat 1, an outboard motor 10*a* for regular rotation and an outboard motor 10*b* for counter rotation are each attached as an outboard motor 10 by a bracket device 3. Here, two outboard motors 10*a*, 10*b* are used, but three or more outboard motors may also be used.

A steering house 4 is formed in a front side of the hull 2. In the steering house 4, a steering wheel 5 is disposed in a front side, and a remote control box 7 having a remote control lever 6 is disposed in a side part for example. The remote control lever 6 is a lever combining a throttle lever and a shift lever.

The outboard motor 10*a* for regular rotation and the outboard motor 10*b* for counter rotation of this embodiment have the same structure except propellers. Therefore, propulsion units, which will be described later, of the outboard motors 10*a*, 10*b* are the same, and thus only one type of propulsion unit should be manufactured and stocked, making parts management simple. Note that a propeller 19*a* for regular rotation is attached to the outboard motor 10*a* for regular rotation, and a propeller 19*b* for counter rotation is attached to the outboard motor 10*b* for counter rotation. Here, the case will be described below where the outboard motor 10*a* moves forward by rightward rotation of the propeller 19*a* for regular rotation, and the outboard motor 10*b* moves forward by leftward rotation of the propeller 19*b* for counter rotation.

Figure 2:
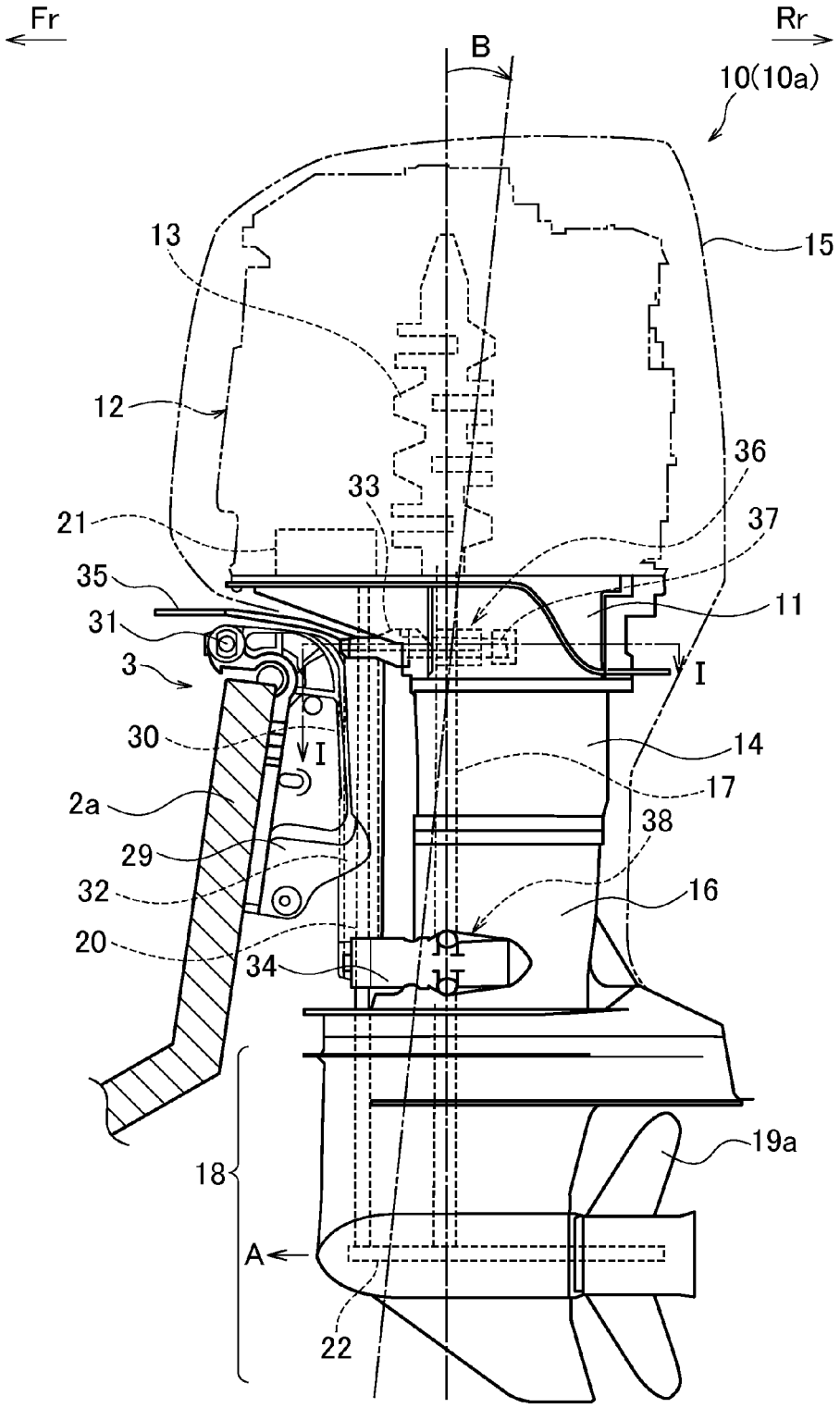
FIG. 2 is a left side view of an outboard motor attached to a boat.

FIG. 2 is a left side view of an outboard motor 10 attached to the hull 2. Here, out of the outboard motor 10*a* for regular rotation and the outboard motor 10*b* for counter rotation, the outboard motor 10*a* for regular rotation is taken as a representative and described mainly. Note that a forward direction is denoted by Fr and a backward direction is denoted by Rr as necessary in the drawings below.

As illustrated in FIG. 2, the outboard motor 10*a* has an engine holder 11, and an engine (internal combustion engine for outboard motor) 12 is installed on an upper side of the engine holder 11. The engine 12 is, for example, a water-cooled four-cycle, four-cylinder engine and is a vertical type engine in which a crank shaft 13 is disposed vertically. An oil pan 14 is disposed on a lower side of the engine holder 11. The surroundings of the engine 12, the engine holder 11 and the oil pan 14 of the outboard motor 10 are covered with an engine cover 15.

A drive shaft housing 16 is disposed in a lower part of the oil pan 14. A drive shaft 17 is disposed substantially vertically inside the engine holder 11, the oil pan 14 and the drive shaft housing 16. The drive shaft 17 has an upper end coupled to a lower end of the crank shaft 13, and a lower end extending into a propulsion unit 18 (gear case) provided in a lower part of the drive shaft housing 16. The propeller 19*a* is disposed in a rear part of the propulsion unit 18. In front of the oil pan 14 and the drive shaft housing 16, a shift rod 20 is disposed substantially vertically. The shift rod 20 has an upper end coupled to an electrical shift device 21 disposed adjacent to the engine 12, and a lower end extending into the propulsion unit 18.

Figure 3:
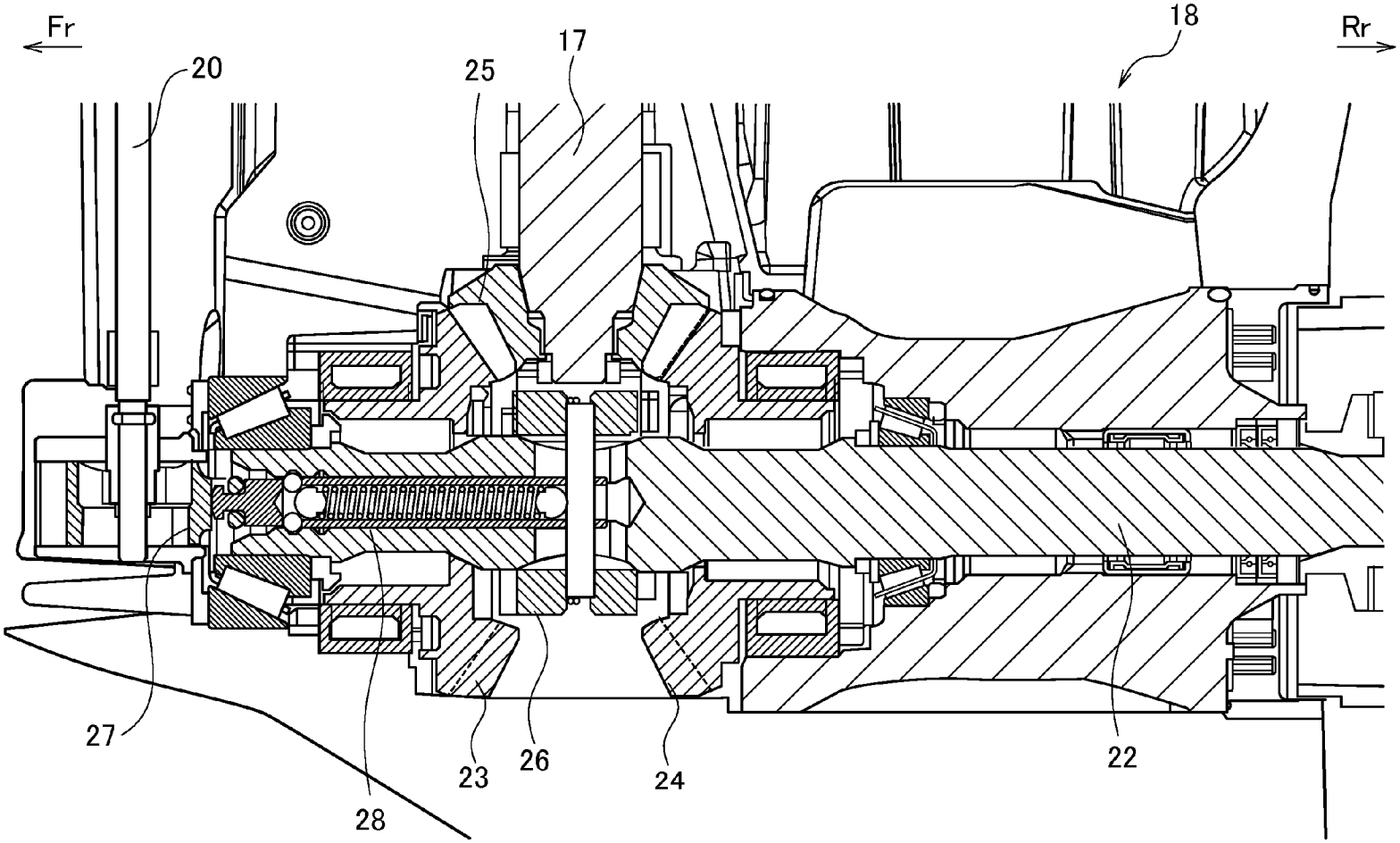
FIG. 3 is a cross-sectional view illustrating a structure of a propulsion unit.

FIG. 3 is a cross-sectional view of the propulsion unit 18.

In the propulsion unit 18, a propeller shaft 22 is supported rotatably along a forward and backward direction. On a lower side of the drive shaft 17, a pair of front and rear gears, a front gear 23 and a rear gear 24, are supported concentrically with the propeller shaft 22 and in a free fit state. The front gear 23 and the rear gear 24 constantly mesh with a bevel gear 25 fixed to a lower end of the drive shaft 17. A dog clutch 26 is disposed between the front gear 23 and the rear gear 24.

The dog clutch 26 exhibits a substantially hollow cylinder shape, and rotates constantly integrally with the propeller shaft 22. The dog clutch 26 is slidable by a predetermined stroke relative to the propeller shaft 22 along an axial direction thereof. Further, the dog clutch 26 engages with the front gear 23 by sliding forward from a neutral state position illustrated in FIG. 3 and rotates integrally with the front gear 23, and engages with the rear gear 24 by sliding backward and rotates integrally with the rear gear 24.

Further, on a lower end part of the shift rod 20, a not-illustrated shift yoke as a cam is provided to project integrally. The shift rod 20 engages with a shift slider 27 disposed in a concentric direction with the propeller shaft 22 via the shift yoke. By axial leftward or rightward rotation of the shift rod 20, the shift yoke presses the shift slider 27, and the shift slider 27 slides forward or backward. Here, the shift rod 20 causes the shift slider 27 to slide forward by axial leftward rotation from the neutral state position, or causes the shift slider 27 to slide backward by axial rightward rotation. The shift slider 27 is coupled to the dog clutch 26 via a connector rod 28 disposed to penetrate the inside of the propeller shaft 22 in an axial direction. Therefore, the dog clutch 26 slides forward or backward in conjunction with forward or backward slide of the shift slider 27.

An operation of the electrical shift device 21 to switch shift of the outboard motor 10*a* in such a structure of the propulsion unit 18 will be described.

The electrical shift device 21 rotates the shift rod 20 leftward from the neutral state position so as to slide the shift slider 27 and the connector rod 28 forward, and thereby the dog clutch 26 engages with the front gear 23. In this case, rotation of the drive shaft 17 is transferred to the propeller shaft 22 via the bevel gear 25, the front gear 23 and the dog clutch 26 to thereby rotate the propeller 19*a* rightward, which is axially attached to the propeller shaft 22, and the outboard motor 10*a* moves forward.

Conversely, the electrical shift device 21 rotates the shift rod 20 rightward from the neutral state position so as to slide the shift slider 27 and the connector rod 28 backward, and thereby the dog clutch 26 engages with the rear gear 24. In this case, rotation of the drive shaft 17 is transferred to the propeller shaft 22 via the bevel gear 25, the rear gear 24 and the dog clutch 26 to thereby rotate the propeller 19*a* leftward, which is axially attached to the propeller shaft 22, and the outboard motor 10*a* moves backward.

Not that in the case of the outboard motor 10*b* for counter rotation, as described above, the propeller 19*b* for counter rotation, whose leftward rotation moves the outboard motor 10*b* forward, is attached to the outboard motor 10*b* for counter rotation.

Therefore, in the case of the outboard motor 10*b* for counter rotation, the electrical shift device 21 rotates the shift rod 20 rightward from the neutral state position so as to slide the shift slider 27 and the connector rod 28 backward, and thereby the dog clutch 26 engages with the rear gear 24. In this case, rotation of the drive shaft 17 is transferred to the propeller shaft 22 via the bevel gear 25, the rear gear 24 and the dog clutch 26 to thereby rotate the propeller 19*b* leftward, which is axially attached to the propeller shaft 22, and the outboard motor 10*b* moves forward.

Conversely, the electrical shift device 21 rotates the shift rod 20 leftward from the neutral state position so as to slide the shift slider 27 and the connector rod 28 forward, and thereby the dog clutch 26 engages with the front gear 23. In this case, rotation of the drive shaft 17 is transferred to the propeller shaft 22 via the bevel gear 25, the front gear 23 and the dog clutch 26 to thereby rotate the propeller 19*b* rightward, which is axially attached to the propeller shaft 22, and the outboard motor 10*b* moves backward.

Referring back to FIG. 2, the structure of the outboard motor 10*a* will be described further. The bracket device 3 attaches to the hull 2 an outboard motor main body including the engine holder 11, the engine 12, the oil pan 14, the drive shaft housing 16 and the propulsion unit 18, and the propeller 19*a*. The bracket device 3 has a pair of left and right clamp brackets 29 and a swivel bracket 30. The clamp brackets 29 are fixed to the transom 2*a*. The swivel bracket 30 is pivotally supported rotatably in an upward and downward direction via a tilt shaft 31 bridged between the pair of left and right clamp brackets 29. In the swivel bracket 30, a pilot shaft 32 is pivotally supported rotatably in a leftward and rightward direction. On an upper and a lower end of the pilot shaft 32, an upper mount bracket 33 and a lower mount bracket 34 are provided respectively. A steering bracket 35 is provided on the upper mount bracket 33, and is coupled to the steering wheel 5 by, for example, a not illustrated cable or the like.

Therefore, the outboard motor main body is steerable leftward and rightward about the pilot shaft 32 relative to the clamp bracket 29, and also tiltable and trimmable vertically about a tilt shaft 31.

An upper mount unit (mount unit 36) as a vibration isolating device is provided in the engine holder 11, and is coupled to the upper mount bracket (mount bracket) 33 by an upper mount bolt (mount bolt) 37 projecting toward the front side from the rear side in the engine holder 11.

Further, on both a left and a right side of the drive shaft housing 16, a pair of lower mount units (mount units) 38 are provided and coupled to the lower mount bracket (mount bracket) 34 by a not-illustrated lower mount bolt (mount bolt).

Figure 4A:
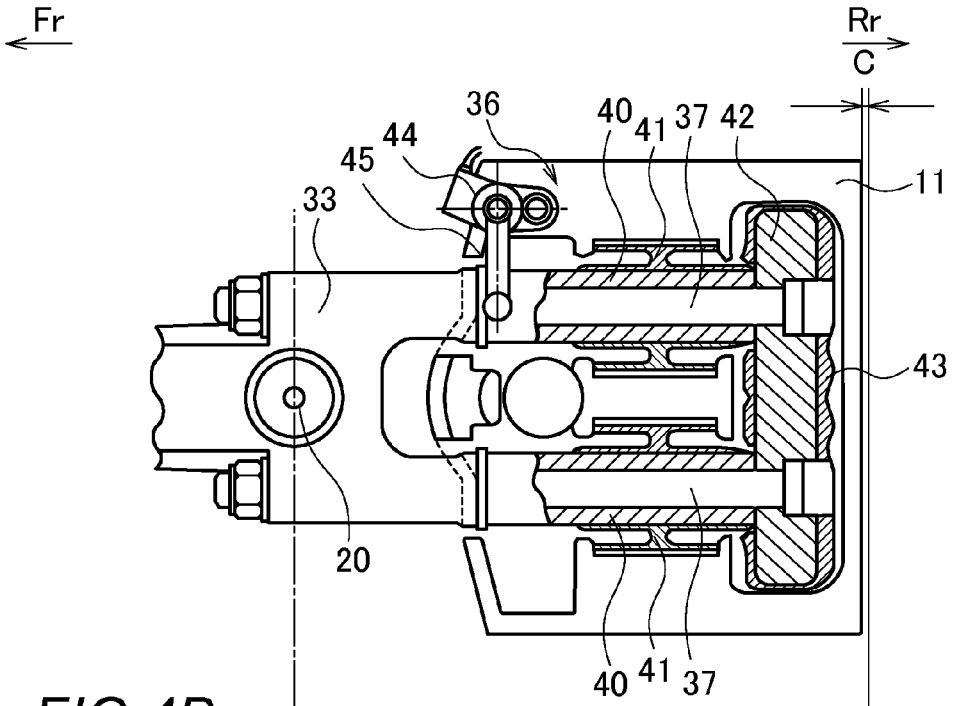
FIG. 4 are partial cross-sectional views illustrating a structure of a mount unit.
Figure 4B:
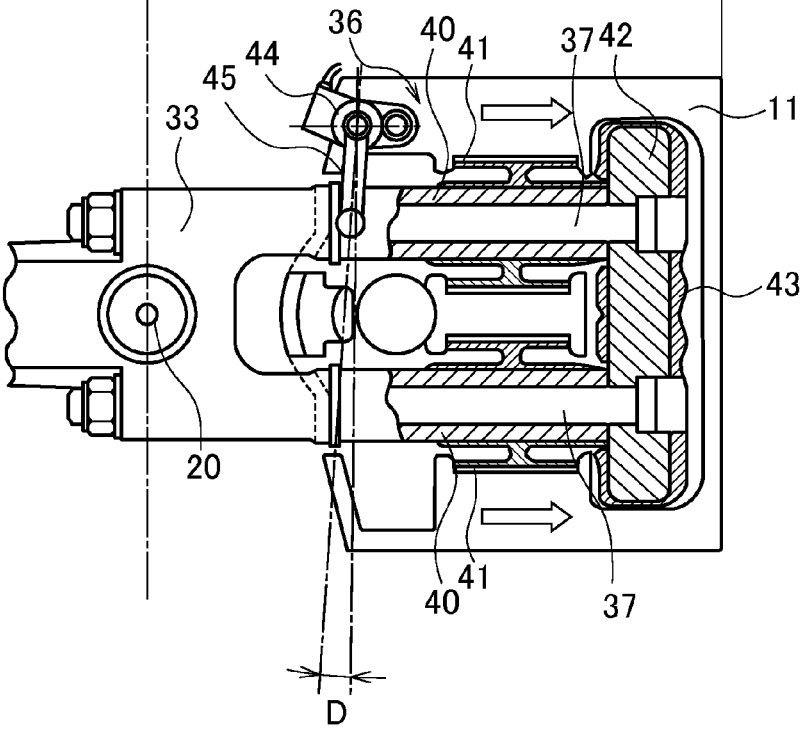

FIG. 4 are cross-sectional views cutting the upper mount unit 36 illustrated in FIG. 2 along a line I-I. The lower mount units 38 are structured substantially similarly to the upper mount unit 36. FIG. 4A illustrates a state before the propeller 19*a* rotates, and FIG. 4B illustrates a state that the propeller 19*a* rotates and the outboard motor main body displaces. As illustrated in FIG. 4A, the upper mount unit 36 has a pair of upper mount bolts 37, inner tubes 40 having a straight tube shape disposed around the respective upper mount bolts 37, a first upper mount (first mount) 41 constituted of an elastic body of rubber or the like disposed to wrap around the respective inner tubes 40, a rod-shaped member 42 which is a rigid member bridged between rear portions of the pair of upper mount bolts 37, and a second upper mount (second mount) 43 constituted of an elastic body of rubber or the like cover around the rod-shaped member 42. A slight gap is formed between the second upper mount 43 and an inside wall of the engine holder 11.

The first upper mount 41 is set to a quite low spring constant, and prevents vibrations generated by the engine 12 at low rotations from being transmitted from the engine holder 11 to the upper mount bracket 33.

When the engine holder 11 displaces backward or forward by propulsive force in the forward direction or backward direction of the propeller 19*a*, the second upper mount 43 restricts excessive displacement of the engine holder 11 by abutting on the inside wall of the engine holder 11. The second upper mount 43 is set to a degree which can prevent vibration transmission of certain level and can restrict abutment of the engine holder 11 on the inside wall by propulsive force of the propeller 19*a*, that is, larger than a spring constant of the first upper mount 41. Thus, the hull main body is supported to float by the upper mount unit 36 and the lower mount units 38.

Referring back to FIG. 2, for example, the case where the outboard motor 10*a* moves forward is assumed. In this case, propulsive force in the forward direction (arrow A direction) by the propeller 19*a* occurs, thus force to move forward operates on the hull 2 on a lower side of the outboard motor 10*a*, and force to move backward operates on the hull 2 on an upper side of the outboard motor 10*a*. Accordingly, the outboard motor main body tilts as indicated by an arrow B direction of FIG. 2. That is, when the outboard motor 10*a* moves forward, the engine holder 11 displaces backward at the upper mount unit 36, and the drive shaft housing 16 displaces forward at the lower mount units 38.

Here, referring back to FIG. 4, an operation of the upper mount unit 36 when the outboard motor 10*a* moves forward will be described. When the outboard motor 10*a* moves forward and the engine holder 11 displaces backward as illustrated in FIG. 4B, the first upper mount 41 deforms first, and then a surface of the second upper mount 43 abuts on the inside wall of the engine holder 11, thereby restricting excessive displacement of the engine holder 11.

Further, as illustrated in FIG. 4A and FIG. 4B, a displacement detector 44 as a propulsion direction detecting unit is attached to the engine holder 11 in the outboard motor 10*a* of this embodiment. The displacement detector 44 detects a relative displacement direction (and displacement amount) in the propulsion direction of the outboard motor 10*a* which occurs by propulsive force in the forward direction or backward direction of the propeller 19*a*, specifically, between the outboard motor main body and the bracket device 3. As the displacement detector 44, for example, a rotation angle sensor having a detection lever 45 which is swingable in a horizontal direction can be used. Here, by engaging the detection lever 45 with a projection formed between the upper mount bracket 33 and the inner tubes 40, the detection lever 45 rotates by angle corresponding to the displacement amount when the engine holder 11 displaces forward or backward. In FIG. 4B, the detection lever 45 rotates by angle D when the engine holder 11 displaces backward by displacement amount C. The displacement detector 44 can output the displacement direction and the displacement amount as a voltage value. Note that the propulsion direction detecting unit may be any unit as long as it can detect the propulsion direction of the outboard motor 10*a* which occurs by propulsive force in the forward direction or backward direction of the propeller 19*a*, and is not limited to the above-described displacement detector 44.

Figure 5:
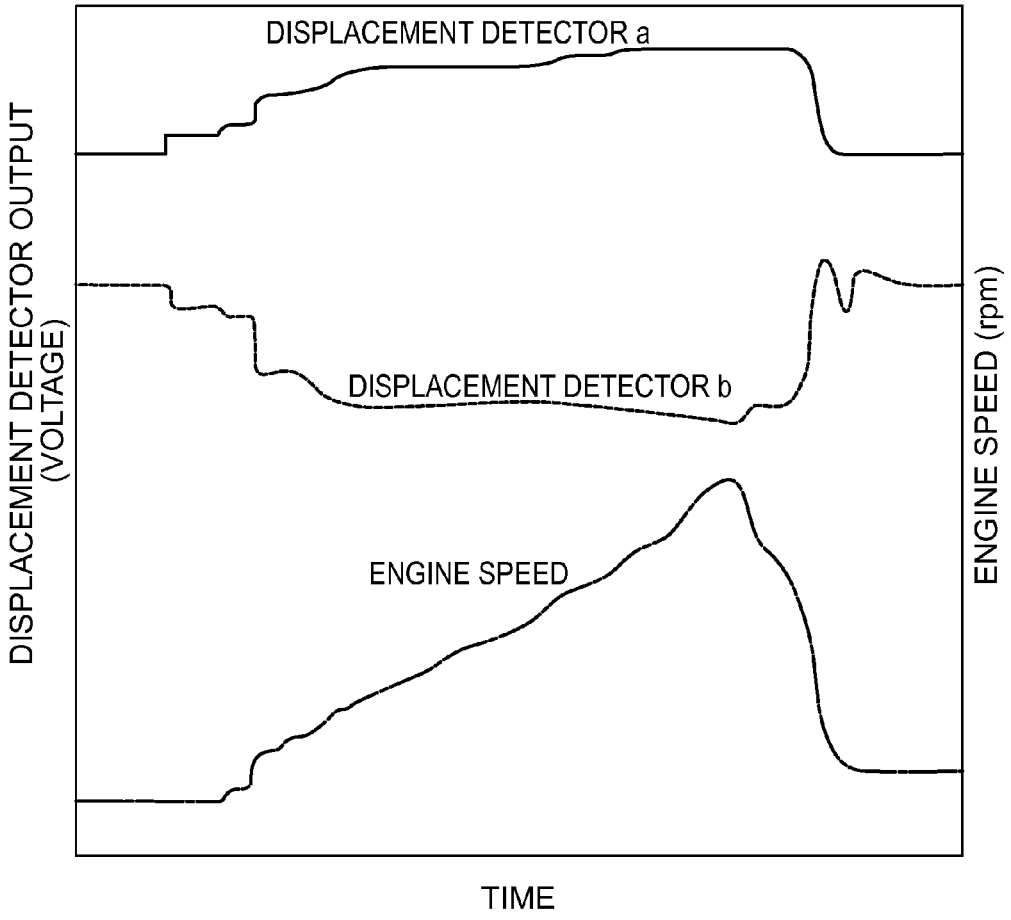
FIG. 5 is a diagram illustrating a change in engine speed and an output change by a displacement detector.

FIG. 5 is a diagram illustrating a change in engine speed and an output change by the displacement detector 44. Here, output (voltage value) of the displacement detector 44 when the outboard motor 10*a* moves forward by increase in engine speed and rotation of the propeller 19*a* is illustrated. A characteristic line of a displacement detector a illustrated in FIG. 5 indicates an output change when the displacement detector 44 is disposed in the upper mount unit 36 as illustrated in FIGS. 4A, 4B. Further, a characteristic line of a displacement detector b illustrated in FIG. 5 indicates an output change when the displacement detector 44 is disposed in the lower mount units 38.

When the outboard motor 10*a* moves forward, since the engine holder 11 displaces backward at the upper mount unit 36 and the drive shaft housing 16 displaces forward at the lower mount units 38, the characteristic value of the displacement detector a increases gradually accompanying increase in engine speed, and the characteristic value of the displacement detector b conversely decreases gradually. Note that when the outboard motor 10*a* moves backward, on the contrary to FIG. 5, the characteristic value of the displacement detector a decreases gradually accompanying increase in engine speed, and conversely the characteristic value of the displacement detector b increases gradually.

Thus, by using the displacement detector 44, the propulsion direction of the outboard motor 10*a* can be detected. The displacement detector 44 can be disposed at least in either of the upper mount unit 36 and the lower mount units 38. However, in view of costs and wetting prevention of the outboard motor 10*a*, it is preferred to be disposed only in the upper mount unit 36.

Next, a main internal structure of the outboard motor 10*a* will be described with reference to a block diagram illustrated in FIG. 6. The entire outboard motor 10*a* is controlled by a control device 50 as a shift control device. The control device 50 is structured to include a CPU 51, a ROM 52, a RAM 53, an EPROM 54, an input circuit 55, an output circuit 56, an ignition device 57 and a power supply circuit 58.

The CPU 51 is what is called a computer, and executes a program stored in the ROM 52 to control an injection amount and injection timing of fuel via an injector 80, or perform shift control via the electrical shift device 21, based on signals outputted from various detectors and the like. Here, the shift control refers to control of switching forward, neutral, reverse of the propulsion direction of the outboard motor 10 by rotating the shift rod 20 leftward or rightward. The ROM 52 is a non-volatile memory and stores programs executed by the CPU 51, initial values when the CPU 51 controls various devices, and so on. The RAM 53 is a non-volatile memory which temporarily stores information or the like calculated when the CPU 51 controls various devices. The EEPROM 54 is a non-volatile memory as a rewritable storage unit which stores information or the like when the CPU 51 controls various devices.

Figure 6:
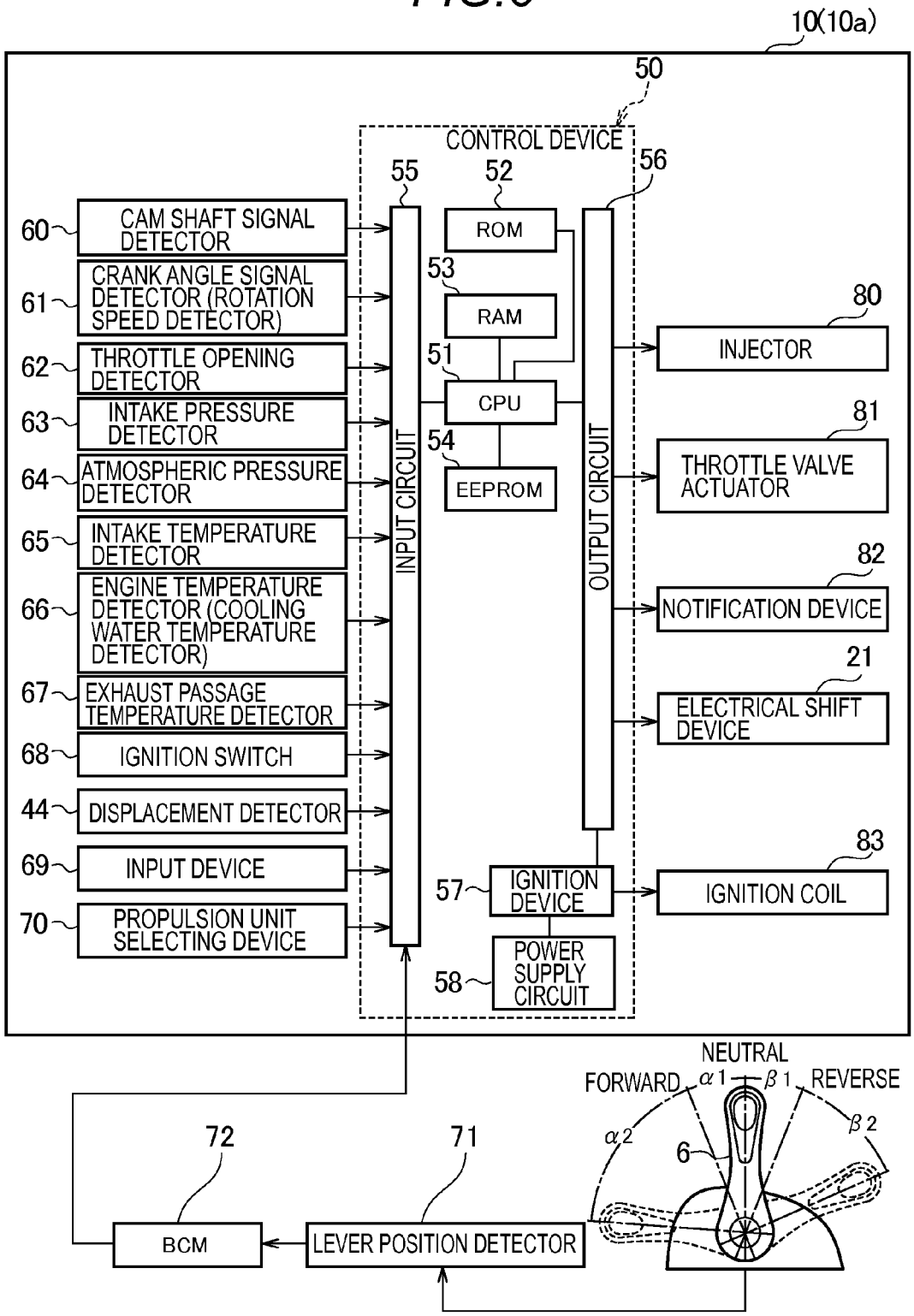
FIG. 6 is a block diagram illustrating a structure of an outboard motor.

To the input circuit 55, a signal is inputted from various detectors or the like from an inside and an outside of the outboard motor 10*a* as illustrated in FIG. 6. Specifically, a cam shaft signal detector 60 outputs a signal of a not-illustrated cam shaft (cam angle signal) of the engine 12. A crank angle signal detector (rotation speed detector) 61 outputs a rotation speed signal of the engine 12.

A throttle opening detector 62 outputs a signal according to a throttle opening of a not-illustrated throttle valve.

An intake pressure detector 63 is disposed in an intake pipe and outputs a signal of intake pressure in the intake pipe. An atmospheric pressure detector 64 outputs a signal of atmospheric pressure. Further, an intake temperature detector 65, an engine temperature detector 66 (cooling water temperature detector) and an exhaust passage temperature detector 67 output signals of a temperature of intake air, temperature of the engine 12 (cooling water temperature) and the exhaust passage, respectively.

An ignition switch 68 is structured so that turning on or off can be selected by a boat operator, where turning on supplies power to respective devices, and turning off cuts off power to respective devices.

The displacement detector 44 detects the propulsion direction of the outboard motor 10*a* generated by propulsive force in the forward direction or backward direction of the propeller 19*a* as described above.

An input device 69 is a device for the boat operator to input whether the outboard motor 10*a* is driven for regular rotation or for counter rotation. Information of the inputted rotation is stored in the input device 69 or the EEPROM 54 as rotation information. For the input device 69, a touch panel installed in the outboard motor 10*a*, a touch panel installed in the steering house 4, or the like can be used.

A propulsion unit selecting device (selecting device) 70 is a device for the boat operator to select whether the outboard motor 10*a* is driven for regular rotation or for counter rotation. Note that in the first embodiment, it will suffice to have at least one of the input device 69 and the propulsion unit selecting device 70.

A lever position detector 71 is disposed in, for example, the remote control box 7 and outputs a signal of position of the remote control lever 6. As illustrated in FIG. 6, regarding the remote control lever 6, a predetermined angle area $\alpha 1$ on a left side of the neutral position is a shift position in the forward direction and a predetermined angle area $\alpha 2$ is a throttle area in the forward direction. Further, a predetermined angle area $\beta 1$ on a right side of the neutral position is a shift position in the backward direction, and a predetermined angle area $\beta 2$ is a throttle area in the backward direction. A signal of the shift position of the remote control lever 6 from the lever position detector 71 is received by a BCM (boat control module) 72, and the BCM 72 outputs the signal to the control device 50. The BCM 72 outputs the signal of shift position of the remote control lever 6 similarly to the control device 50 of the outboard motor 10*b*. Note that the control device 50 may directly receive the signal of the shift position of the remote control lever 6.

The output circuit 56 transmits a signal for controlling the injector 80, a throttle valve actuator 81, a notification device 82 as a notification unit, the electrical shift device 21 and an ignition coil 83.

A signal from each device inputted to the control device 50 is appropriately subjected to arithmetic processing in the CPU 51, and an arithmetic result thereof is outputted to each device inside or outside the outboard motor 10*a* via the output circuit 56. Specifically, the CPU 51 controls the injector 80 so that it has appropriate fuel jetting timing and jetting amount according to the operating state of the engine 12, or controls ignition timing of the ignition coil 83 via the ignition device 57.

The CPU 51 electrically switches whether to drive the outboard motor 10*a* for regular rotation or for counter rotation based on rotation information inputted from the input device 69. This processing corresponds to an example of processing by a rotation switching unit. That is, the CPU 51 controls in the outboard motor 10*a* the electrical shift device 21 based on rotation information and the signal of shift position of the remote control lever 6. Specifically, for example, a table is stored in the EEPROM 54 or the like, in which rotation directions of the shift rod 20 by the electrical shift device 21 are associated with the rotation information and the signal of shift position as illustrated in FIG. 7. The CPU 51 can control the electrical shift device 21 by referring to the table illustrated in FIG. 7.

Here, when the rotation information is regular rotation, the CPU 51 controls the electrical shift device 21 so that the outboard motor 10*a* is in the forward direction when the signal of shift position of forward direction is received. Specifically, in the above-described structure of the outboard motor 10*a*, the CPU 51 rotates the shift rod 20 leftward from the neutral state position via the electrical shift device 21 to engage the dog clutch 26 with the front gear 23, and thereby the propeller 19*a* rotates rightward and the outboard motor 10*a* moves forward.

Further, when the signal of shift position of backward direction is received, the CPU 51 controls the electrical shift device 21 so that the outboard motor 10*a* is in the backward direction. Specifically, in the above-described structure of the outboard motor 10*a*, the CPU 51 rotates the shift rod 20 rightward from the neutral state position via the electrical shift device 21 to engage the dog clutch 26 with the rear gear 24, and thereby the propeller 19*a* rotates leftward and the outboard motor 10*a* moves backward.

Further, for example, when the rotation information is counter rotation, the CPU 51 controls the electrical shift device 21 so that the outboard motor 10*b* is in the forward direction when the signal of shift position of forward direction is received. Specifically, the CPU 51 rotates the shift rod 20 rightward from the neutral state position via the electrical shift device 21 to engage the dog clutch 26 with the rear gear 24, and thereby the propeller 19*b* rotates leftward and the outboard motor 10*a* moves forward.

Further, when the signal of shift position of backward direction is received, the CPU 51 controls the electrical shift device 21 so that the outboard motor 10*b* is in the backward direction. Specifically, the CPU 51 rotates the shift rod 20 leftward from the neutral state position via the electrical shift device 21 to engage the dog clutch 26 with the front gear 23, and thereby the propeller 19*b* rotates rightward and the outboard motor 10*a* moves backward.

Thus, the CPU 51 performs shift control based on the rotation information indicating whether to drive for regular rotation or for counter rotation inputted by the boat operator and the signal of shift position.

Therefore, even when propulsion units for regular rotation and for counter rotation are made as a common unit, by just inputting whether the outboard motor 10*a* is driven for regular rotation or driven for counter rotation by the operator, it is possible to drive the outboard motor 10*a* by the rotation according to the input. Further, it is just necessary to structure such that the boat operator allows the signal of shift position of the remote control lever 6 to be outputted to the respective control devices 50 of the outboard motors 10*a*, 10*b*, and thus the structure of the outboard motors 10*a*, 10*b* can be simplified. Therefore, the boat operator can perform an operation of shifting the plural outboard motors 10*a*, 10*b* by one remote control lever 6, and thus the operation of the outboard motors 10*a*, 10*b* does not become complicated.

Incidentally, in the outboard motor 10*a* structured as described above, although the propulsion unit for regular rotation and for counter rotation can be made as a common unit, it is conceivable that the propeller 19*b* for counter rotation is attached to the outboard motor 10*a* to be driven for regular rotation or that the propeller 19*a* for regular rotation is attached to the outboard motor 10*b* to be driven for counter rotation. In such cases, the outboard motors 10*a*, 10*b* attempt to drive in a direction different from the shift operation via the remote control lever 6 by the boat operator, and thus they cannot exhibit the desired functions of the outboard motors 10*a*, 10*b*.

Figure 8:
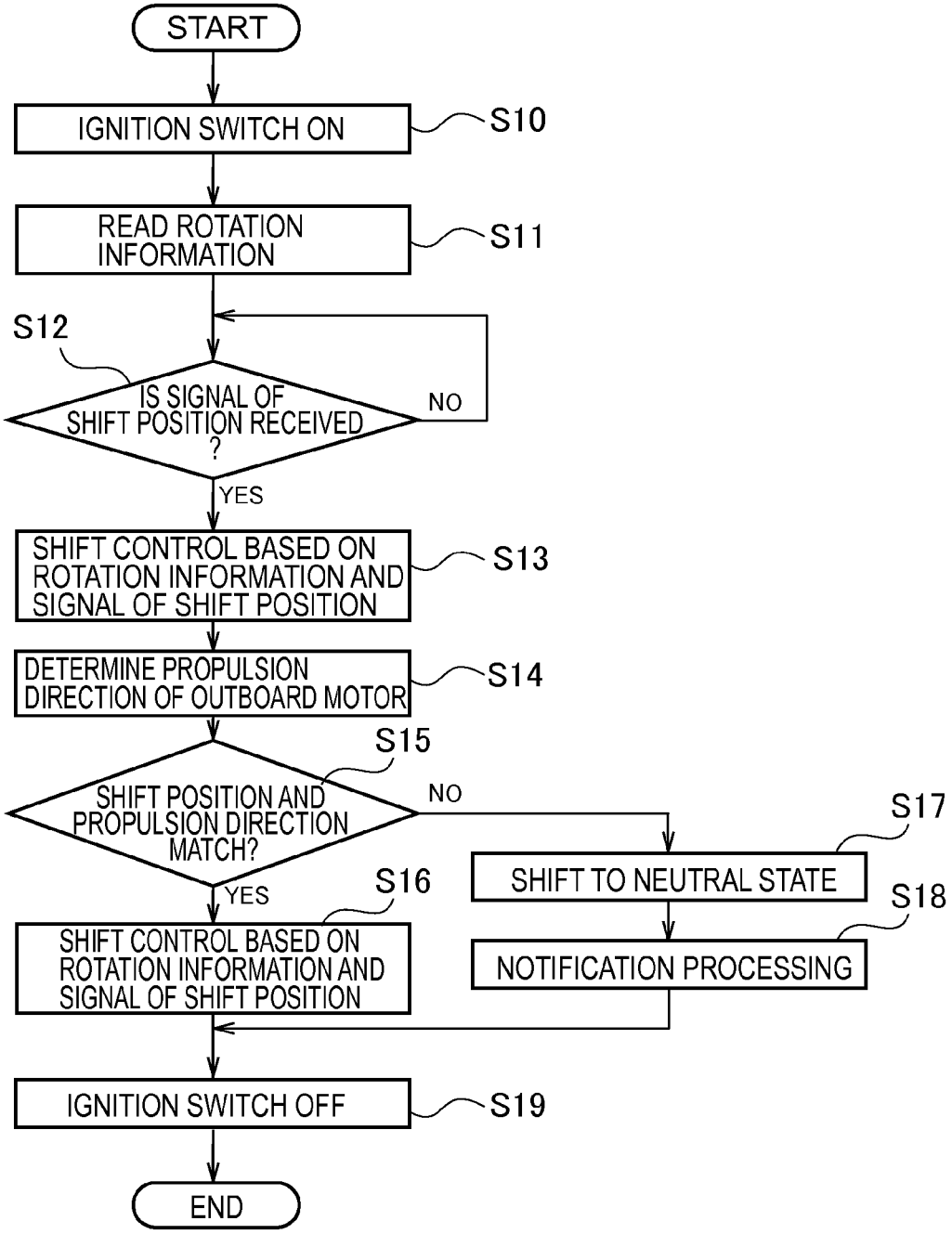
FIG. 8 is a flowchart illustrating processing of shift control of a first embodiment.

Accordingly, in this embodiment, the control device 50 performs control to determine rotation of the outboard motors 10*a*, 10*b*, and notify the boat operator when the case where the outboard motors 10*a*, 10*b* cannot exhibit the desired function. FIG. 8 is a flowchart illustrating processing of the control device 50 according to this embodiment. The flowchart illustrated in FIG. 8 is realized by the CPU 51 spreading in the RAM 53 a program stored in the ROM 52 and executing this program. Here, the control device 50 of the outboard motor 10*a* will be described as a representative, but the same applies to the outboard motor 10*b*.

In step S10, the CPU 51 supplies power to respective devices and drive the engine 12 according to an operation to turn on the ignition switch 68 by the boat operator, thereby starting operation of the outboard motor 10.

In step S11, the CPU 51 reads the rotation information indicating whether it is for regular rotation or for counter rotation inputted via the input device 69. Here, it is assumed that the rotation information is regular rotation.

In step S12, the CPU 51 judges whether the signal of shift position (forward direction or backward direction) of the remote control lever 6 by the lever position detector 71 is received or not. When it is received, the flow proceeds to step S13, or when it is not received, the CPU waits for reception.

In step S13, the CPU 51 performs shift control via the electrical shift device 21 by referring to the table illustrated in FIG. 7 based on the rotation information and the received signal of shift position. At this time, the outboard motor main body tilts according to the propulsive force of the forward direction or backward direction by rotation of the propeller 19*a*.

In step S14, the CPU 51 receives a signal of displacement direction, which is outputted by the displacement detector 44, of the outboard motor main body generated by tilting of the outboard motor main body. The CPU 51 judges whether the outboard motor 10*a* actually moves forward or backward according to the received signal of displacement direction, that is, the propulsion direction of the outboard motor 10*a*.

In step S15, the CPU 51 judges whether the propulsion direction of the outboard motor 10*a* and the shift position received in step S12 match or not. This processing corresponds to an example of processing by a judgment unit. Normally, the actual propulsion direction and the shift position of the remote control lever 6 match. However, when the propeller 19*b* for counter rotation is attached to the outboard motor 10*a* to be driven for regular rotation or the propeller 19*a* for regular rotation is attached to the outboard motor 10*b* to be driven for counter rotation, the actual propulsion direction and the shift position do not match. In such cases, the outboard motors 10*a*, 10*b* cannot exhibit desired performances. When the propulsion direction and the shift position match, the flow proceeds to step S16, or when they do not match, the flow proceeds to step S17.

For example, when the rotation information is the regular rotation, if the shift position is the forward direction and the propulsion direction is the forward direction, the CPU 51 can determine that it is an outboard motor to which the propeller 19*a* for regular rotation is attached to be driven for regular rotation. On the other hand, if the shift position is the forward direction and the propulsion direction is the backward direction, the CPU can determine that it is an outboard motor to which the propeller 19*b* for counter rotation is attached to be driven originally for counter rotation. This processing corresponds to an example of processing by a rotation determination unit.

In step S16, the actual propulsion direction and the shift position match, and thus the CPU 51 continues performing shift control via the electrical shift device 21 based on the shift position and the rotation information of the remote control lever 6.

On the other hand, in step S17, since the actual propulsion direction and the shift position do not match, first the CPU 51 changes the shift to the neutral state. Specifically, the CPU 51 rotates the shift rod 20 to a neutral position via the electrical shift device 21, so that rotation of the drive shaft 17 is not transferred to the propeller shaft 22. This processing corresponds to an example of processing by an interruption unit. Therefore, propulsive force more than necessary by the propeller 19*a* can be interrupted. Note that the CPU 51 is not limited to the case where the shift is changed to the neutral state, and may control the engine speed so as not to be equal to or more than a predetermined engine speed. This processing corresponds to an example of processing by an engine speed control unit. Further, the CPU 51 may perform processing to stop the engine 12.

In step S18, the CPU 51 notifies the boat operator that the outboard motor 10*a* cannot perform a desired performance, that is, the shift position and the propulsion direction do not match. This processing corresponds to an example of processing by a notification processing unit. Specifically, the CPU 51 displays on a monitor as the notification device 82 a message about that a different propeller is attached, or the like, or generates a warning sound (or warning voice) via a buzzer as the notification device 82. Therefore, the boat operator notices that, for example, a wrong propeller is attached and can replace it with a propeller which exhibits the desired performance.

In step S19, the CPU 51 stops power supply to respective devices by turning off the ignition switch 68 by the boat operator.

Thus, in this embodiment, a notification is made to the boat operator when desired performances cannot be obtained by the outboard motor for regular rotation and the outboard motor for counter rotation, and thus the boat operator can replace, for example, a wrong propeller to a propeller which can exhibit the desired performances.

Further, the boat operator can easily switch whether to drive the outboard motor 10 for regular rotation or for counter rotation via the input device 69. Note that in this embodiment, the case where the rotation information is inputted via the input device 69 has been described, but the invention is not limited to this case. For example, rotation can be selected (inputted) by using a propulsion unit selecting device 70 illustrated in FIG. 6.

For example, for the propulsion unit selecting device 70, what is called a toggle switch or the like which can select whether to drive for regular rotation or for counter rotation can be used. In this case, the CPU 51 can obtain the rotation information based on the position of the toggle switch.

Further, for example, voltage level (high/low) changing according to a resistance element inserted in an input unit of the propulsion unit selecting device 70 can be taken as the rotation information. Specifically, when the input unit is released, the outboard motor can be driven for predetermined rotation, or when the resistance element is connected, it can be driven for different rotation.

Second Embodiment

Next, a second embodiment will be described. In the first embodiment, the case is described where the boat operator inputs in advance whether to drive the outboard motors for regular rotation or for counter rotation via the input device 69. In this embodiment, the case will be described where the CPU 51 performs control to switch rotation automatically according to the shift position when the propulsion direction and the shift position do not match. Therefore, in this embodiment, the input device 69 and the propulsion unit selecting device 70 illustrated in FIG. 6 may be omitted.

Figure 9:
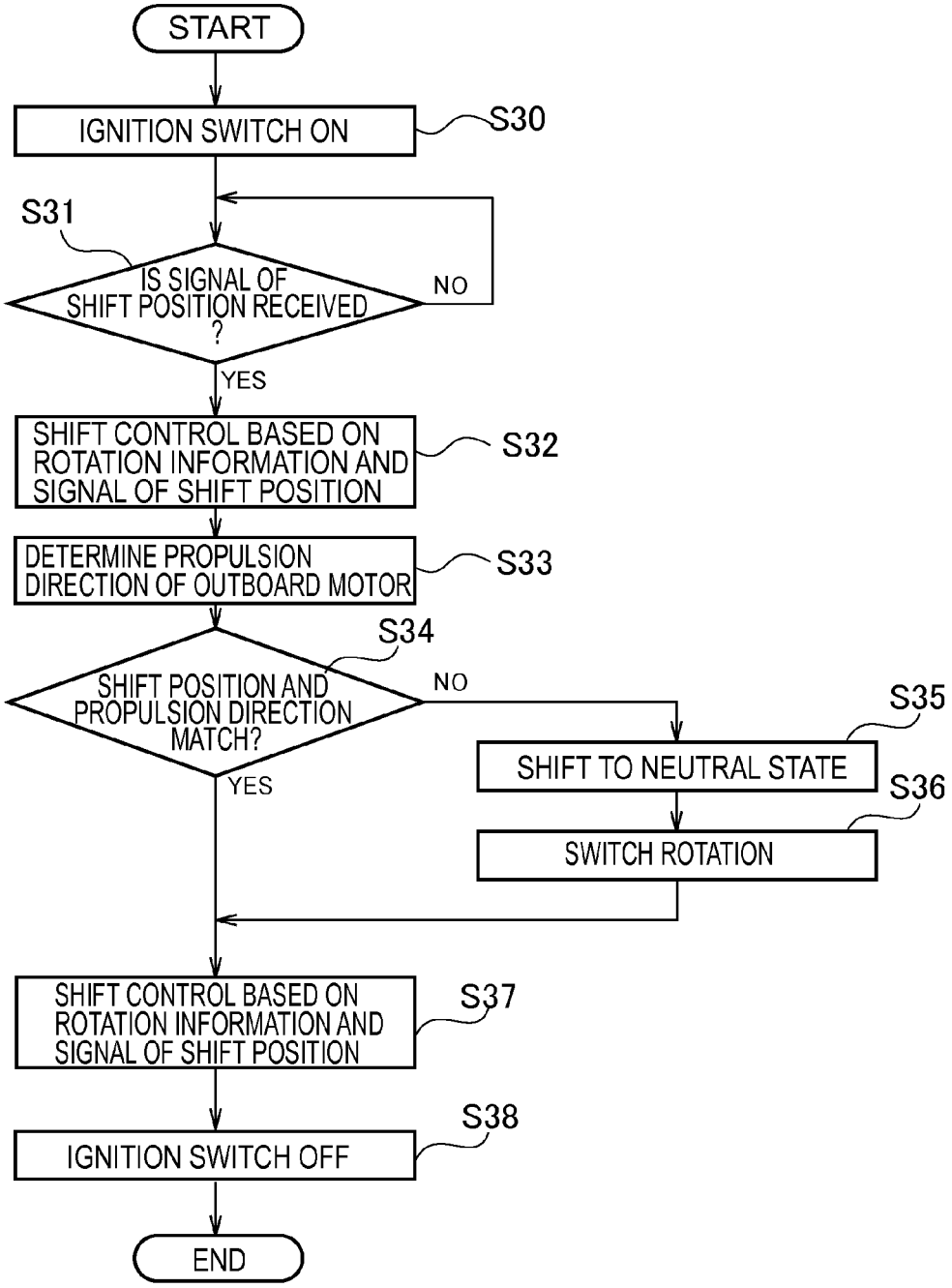
FIG. 9 is a flowchart illustrating processing of shift control of a second embodiment.

FIG. 9 is a flowchart illustrating processing of a control device 50 according to this embodiment. The flowchart illustrated in FIG. 9 is realized by the CPU 51 spreading and executing in the RAM 53 a program stored in the ROM 52. Here, the control device 50 of the outboard motor 10*a* will be described as a representative, but the same applies to the outboard motor 10*b*.

In step S30, the CPU 51 supplies power to respective devices and drive the engine 12 according to an operation to turn on the ignition switch 68 by the boat operator, thereby starting operation of the outboard motor 10. In this embodiment, the boat operator need not input whether it is for regular rotation or for counter rotation, and for example, regular rotation is stored as an initial value in the EEPROM 54 as rotation information in advance without distinguishing the outboard motors 10*a*, 10*b*.

In step S31, the CPU 51 judges whether a signal of a shift position (forward direction or backward direction) of the remote control lever 6 by the lever position detector 71 is received or not. When it is received, the flow proceeds to step S32, or when it is not received, the CPU waits for reception.

In step S32, the CPU 51 performs shift control via the electrical shift device 21 by referring to the table illustrated in FIG. 7 based on the rotation information and the received signal of shift position. At this time, the outboard motor main body tilts according to the propulsive force of the forward direction or backward direction by rotation of the propeller 19*a*.

In step S33, the CPU 51 receives a signal of displacement direction, which is outputted by the displacement detector 44, of the outboard motor main body generated by tilting of the outboard motor main body. The CPU 51 judges whether the outboard motor 10*a* actually moves forward or backward according to the received signal of displacement direction, that is, the propulsion direction of the outboard motor 10*a*.

In step S34, the CPU 51 judges whether the propulsion direction of the outboard motor 10*a* and the shift position received in step S31 match or not. This processing corresponds to an example of processing by a judgment unit. When the propulsion direction and the shift position match, the flow proceeds to step S37, or when they do not match, the flow proceeds to step S35.

For example, when the shift position is the forward direction and the propulsion direction is the forward direction (match), the CPU 51 can determine that it is an outboard motor to be driven for regular rotation. Further, when the shift position is the forward direction and the propulsion direction is the backward direction (no match), the CPU can determine that it is an outboard motor to be driven originally for counter rotation. This processing corresponds to an example of processing by a rotation determination unit.

In step S35, since the actual propulsion direction and the shift position do not match, the CPU 51 changes the shift to the neutral state. Specifically, the CPU 51 rotates the shift rod 20 to a neutral position via the electrical shift device 21, so that rotation of the drive shaft 17 is not transferred to the propeller shaft 22. This processing corresponds to an example of processing by an interruption unit. Therefore, propulsive force more than necessary by the propeller 19*a* can be interrupted.

In step S36, the CPU 51 switches the rotation. The CPU 51 rotates the shift rod 20 in an opposite direction of the direction of rotation in step S32. Therefore, the actual propulsion direction of the outboard motor 10*a* and the shift position received in step S31 can be matched. Moreover, the CPU 51 updates the rotation information stored as an initial value by switching it to different rotation. This processing corresponds to an example of processing by a rotation switching unit. Specifically, here the CPU 51 switches the rotation information from regular rotation to counter rotation and stores it in the EEPROM 54. This processing corresponds to an example of processing by a storage processing unit. Therefore, it is possible to electrically switch driving of the outboard motor 10*a* for counter rotation.

In step S37, the CPU 51 thereafter performs the shift control via the electrical shift device 21 based on the shift position and the rotation information of the remote control lever 6. Specifically, the CPU 51 performs, for example, the shift control via the electrical shift device 21 by referring to the table illustrated in FIG. 7.

In step S38, the CPU 51 stops power supply to respective devices by turning off the ignition switch 68 by the boat operator.

Thus, according to this embodiment, the boat operator need not input whether to drive the outboard motors 10*a*, 10*b* for regular rotation or for counter rotation via the input device 69 or the like. That is, by the boat operator operating the remote control lever 6, the CPU 51 determines the rotation of each of the outboard motors 10*a*, 10*b*, and automatically switches the rotation when they are different. Therefore, the boat operator can drive the outboard motors 10*a*, 10*b* in the propulsion direction according to the shift position of the remote control lever 6 by just attaching the propeller 19*a* for regular rotation and the propeller 19*b* for counter rotation to the respective outboard motors 10*a*, 10*b* without distinguishing them.

Further, by storing the rotation information in a rewritable non-volatile memory such as the EEPROM 54, in the next operation the CPU 51 can drive the outboard motors 10*a*, 10*b* based on the rotation information switched previously. Therefore, in the next operation, the operation of the outboard motors 10*a*, 10*b* can be started early without proceeding from step S34 to step 35 illustrated in FIG. 9. Note that thereafter, when the propulsion unit 18 is replaced, the flow proceeds from step S34 to step 35 illustrated in FIG. 9 even when the propeller 19*a* for regular rotation and the propeller 19*b* for counter rotation are attached in reverse, and thus the rotation is switched again.

Figure 10:
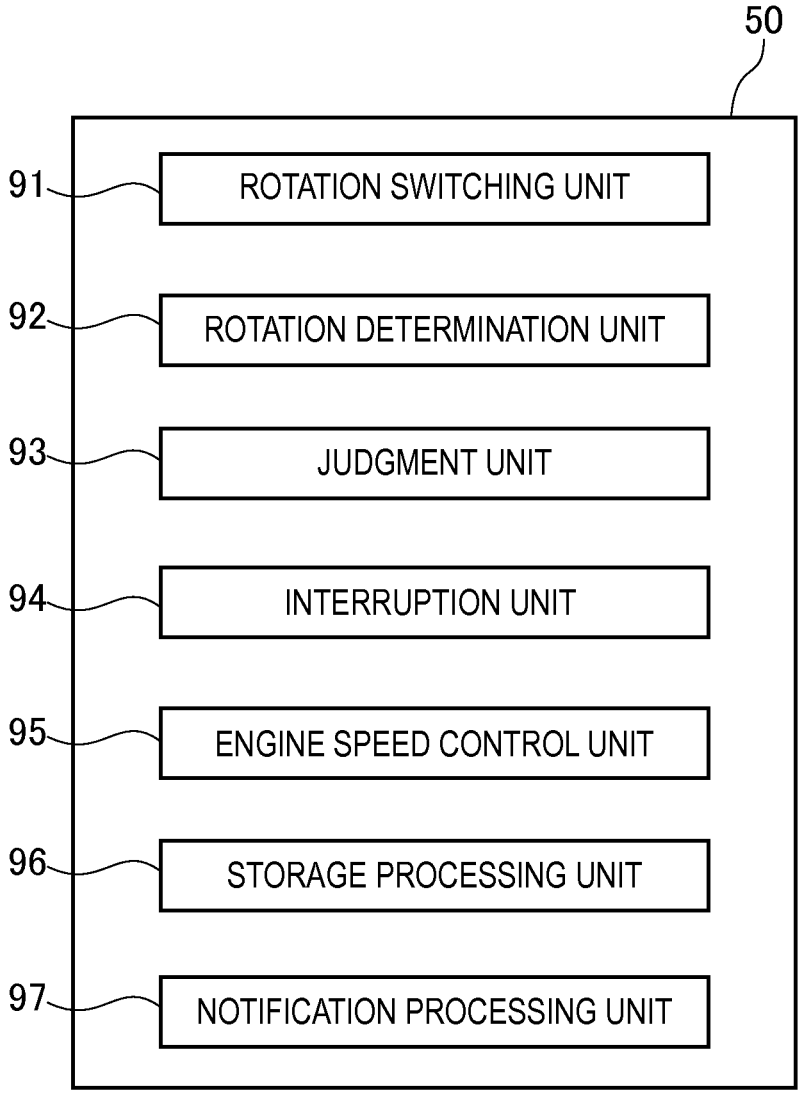
FIG. 10 is a diagram illustrating a functional structure of a shift control device.

FIG. 10 is a diagram illustrating an example of a functional structure of the control devices of the outboard motors of the first and second embodiments. The functional structure illustrated in FIG. 10 is realized by the CPU 51 spreading in the RAM 53 a program stored in the ROM 52 and executing this program.

The control device 50 is structured to include a rotation switching unit 91, a rotation determination unit 92, a judgment unit 93, an interruption unit 94, an engine speed control unit 95, a storage processing unit 96 and a notification processing unit 97.

The rotation switching unit 91 electrically switches whether to drive the outboard motor 10 for regular rotation or for counter rotation.

The rotation determination unit 92 judges whether the outboard motor 10 drives for regular rotation or for counter rotation.

The judgment unit 93 judges whether the shift position of the remote control lever 6 for switching the propulsion direction of the outboard motor 10 and the propulsion direction of the outboard motor 10 match or not.

The interruption unit 94 prevents transfer of rotation of the drive shaft 17 to the propeller shaft 22.

The engine speed control unit 95 controls the engine speed of the outboard motor 10 not to be larger than a predetermined engine speed.

The storage processing unit 96 stores rotation information of rotation switched by the rotation switching unit 91 in a rewritable non-volatile memory such as the EEPROM 54.

The notification processing unit 97 notifies the boat operator via the notification device 82.

In the foregoing, the present invention has been explained with the above-described embodiments, but the present invention is not limited to the above-described embodiments. The first and second embodiments can be combined appropriately or changed within the range of the present invention.

For example, in the above-described embodiments, the structure is explained in which the propeller 19*a* rotates rightward by the electrical shift device 21 rotating the shift rod 20 rightward, but a structure may be employed in which the propeller 19*a* rotates rightward by rotating the shift rod 20 leftward.

In the above-described first and second embodiments, when the displacement direction of the outboard motor main body is detected, the CPU 51 may control it to the engine speed by which the displacement direction of the outboard motor main body can be detected easily by the supply amount of air via a throttle valve actuator 81 (or not illustrated air amount regulating actuator (ISC)), ignition timing via the ignition coil 83, or the like.

Further, in the above-described first and second embodiments, the case is described where the above-described processing is realized by the CPU 51 executing a program, but the invention is not limited to this case. Circuits structured by hardware may execute the above-described processing. Further, the present invention includes the above-described program and a computer readable recording medium recording this program.

INDUSTRIAL APPLICABILITY

The present invention can be utilized when a propulsion unit for regular rotation and a propulsion unit for counter rotation are made as a common unit.

The invention claimed is:

1. A shift control device of an outboard motor having an electrical shift device for switching a propulsion direction, the shift control device comprising:

a rotation switching unit electrically switching whether to drive the outboard motor for regular rotation or for counter rotation, a propulsion direction detecting unit detecting a propulsion direction of the outboard motor, a rotation determination unit determining whether the outboard motor drives for regular rotation or for counter rotation based on a shift position of a remote control lever for switching the propulsion direction of the outboard motor and a propulsion direction detected by the propulsion direction detecting unit, a judgment unit judging whether the shift position of the remote control lever and the propulsion direction detected by the propulsion direction detecting unit match or not; and a notification unit giving a notification that the shift position and the propulsion direction are different when the judgment unit judges that the shift position and the propulsion direction do not match.

2. The shift control device of the outboard motor according to claim 1, wherein the outboard motor includes a bracket device for attaching the outboard motor main body to a hull, and the propulsion direction detecting unit detects the propulsion direction of the outboard motor according to a relative displacement between the bracket device and the outboard motor main body.

3. The shift control device of the outboard motor according to claim 1, further comprising:

an interruption unit interrupting transfer of drive of an engine of the outboard motor when the judgment unit judges that the shift position and the propulsion direction do not match.

4. The shift control device of the outboard motor according to claim 1, further comprising:

a judgment unit judging whether a shift position of a remote control lever for switching the propulsion direction of the outboard motor and a propulsion direction detected by the propulsion direction detecting unit match or not; and an engine speed control unit controlling the engine speed of the outboard motor not to be equal to or more than a predetermined engine speed when the judgment unit judges that the shift position and the propulsion direction do not match.

5. The shift control device of the outboard motor according to claim 1, wherein the rotation switching unit electrically switches rotation based on rotation information indicating whether the outboard motor is to be driven for regular rotation or for counter rotation, which is inputted by a boat operator via an input device or a selection device.

6. The shift control device of the outboard motor according to claim 1, wherein the rotation switching unit electrically switches whether to drive the outboard motor for regular rotation or for counter rotation when the judgment unit judges that the shift position and the propulsion direction do not match.

7. The shift control device of the outboard motor according to claim 6, further comprising a storage processing unit storing rotation information of rotation switched by the rotation switching unit in a rewritable non-volatile memory, wherein shift of the outboard motor is controlled based on the rotation information stored by the storage processing unit and a shift position of a remote control lever for switching the propulsion direction of the outboard motor.

8. A shift control method of an outboard motor having an electrical shift device for switching a propulsion direction, the method comprising:

a rotation switching step of electrically switching whether to drive the outboard motor for regular rotation or for counter rotation, a rotation determination step of determining whether the outboard motor drives for regular rotation or for counter rotation, a step determining whether a shift position of the remote control lever and a propulsion direction of the outboard motor match or not; and a notification step notifying a boat operator that the shift position and the propulsion direction do not match when the shift position of the remote control lever and the propulsion direction of the outboard motor do not match.

9. A computer readable non-transitory recording medium with program for controlling an outboard motor having an electrical shift device for switching a propulsion direction, the program causing a computer to execute:

a rotation switching step of electrically switching whether to drive the outboard motor for regular rotation or for counter rotation, a rotation determination step of determining whether the outboard motor drives for regular rotation or for counter rotation, a step determining whether a shift position of the remote control lever and a propulsion direction of the outboard motor match or not; and a notification step notifying a boat operator that the shift position and the propulsion direction do not match when the shift position of the remote control lever and the propulsion direction of the outboard motor do not match.

* * * * *